US005722625A

United States Patent [19]

Kenney

[11] Patent Number: 5,722,625

[45] Date of Patent: Mar. 3, 1998

[54] SHELF BRACKET

[76] Inventor: Richard E. H. Kenney, 224 Earl Stewart Drive, Aurora, Ontario, Canada, L4G 6S5

[21] Appl. No.: 739,909

[22] Filed: Oct. 30, 1996

[51] Int. Cl.[6] ..... A47F 5/00; A47B 91/06

[52] U.S. Cl. ..... 248/220.41; 211/59.1; 248/220.31

[58] Field of Search ..... 248/220.41, 220.31, 248/220.21, 303, 222.51; 211/57.1, 59.1, 106, 86.9, 88.01; 40/360, 10 R, 642.01, 642.02, 661.03

[56] References Cited

U.S. PATENT DOCUMENTS

| | | | |
|---|---|---|---|
| 4,351,440 | 9/1982 | Thalenfeld | 248/220.41 X |
| 4,405,110 | 9/1983 | Gibbons | 248/220.41 X |
| 4,476,983 | 10/1984 | Fast | 211/57.1 |
| 4,497,464 | 2/1985 | Fast | 248/220.3 |
| 4,546,943 | 10/1985 | Fast | 248/205.3 |
| 4,713,899 | 12/1987 | Fast | 40/10 R |
| 4,809,940 | 3/1989 | Trestyn | 248/222.51 X |
| 4,898,354 | 2/1990 | Whittington et al. | 248/220.31 X |
| 5,060,897 | 10/1991 | Thalenfeld | 248/220.4 |
| 5,080,238 | 1/1992 | Hochman | 248/220.41 X |
| 5,224,609 | 7/1993 | Bauer et al. | 248/220.41 X |
| 5,339,967 | 8/1994 | Valinlis | 211/57.1 |
| 5,346,166 | 9/1994 | Valinlis | 248/220.4 |
| 5,379,976 | 1/1995 | DeGirolamo | 248/222.51 X |
| 5,415,370 | 5/1995 | Valinlis | 248/220.4 |
| 5,429,334 | 7/1995 | Hutchison | 248/220.41 |
| 5,442,872 | 8/1995 | Moser | 40/642.01 |
| 5,620,104 | 4/1997 | Maglione | 248/220.41 X |

FOREIGN PATENT DOCUMENTS

| | | | |
|---|---|---|---|
| 283947 | 11/1952 | Switzerland | 248/220.41 |
| 375600 | 4/1964 | Switzerland | 248/220.41 |

*Primary Examiner*—Peter M. Cuomo
*Assistant Examiner*—Robert J. Sandy
*Attorney, Agent, or Firm*—Ridout & Maybee

[57] ABSTRACT

A shelf bracket is in the form of a unitary one piece molded plastics material body having a planar plate portion and two laterally spaced and parallel downwardly and rearwardly extending L-shaped leg portions molded integrally with a lower face of the plate portion. The legs extend adjacent a rear edge of the plate portion for engaging in and locating the plate portion relative to perforations in conventional perforated shelving. The plate portion tapers in width toward a front apex, and has a bottom web integrally molded with the plate portion and extending downwardly substantially perpendicularly from its lower face. The web may have informational material applied to it or may have merchandising devices fastened to it.

13 Claims, 6 Drawing Sheets

SHELF BRACKET

Present invention relates to a shelf bracket for use in attachment of point of sale informational material and devices, for example strip merchandising devices to conventional perforated shelving.

Known bracket devices of which the applicant is aware have the disadvantage that they obscure an undesirably large area of the shelf space or do not provide an adequately stable and secure attachment.

The present invention provides a shelf bracket comprising a unitary one piece molded plastics material body comprising a planar plate portion, two laterally spaced and generally parallel downwardly and rearwardly extending L-shaped leg portions molded integrally with a lower face of said plate portion adjacent a rear edge thereof for engaging in and locating and retaining said first plate portion relative to respective perforations in a sheet form shelving member, said plate portion tapering in width toward a front apex from said rear edge, and a bottom web integrally molded with said plate portion and extending downwardly substantially perpendicularly from the lower face thereof longitudinally rearwardly from the apex toward an upwardly extending rear-facing edge spaced forwardly from said leg portions.

With this arrangement, the bottom web which provides an anchorage to which merchandising material and devices may be attached has a relatively slim profile and obscures a relatively small area of the shelf space.

The bracket may be molded of sturdy plastics material, and provides a stable and secure attachment to the perforated shelving.

Examples of preferred embodiments of the invention will now be described, by way of example only, with reference to the accompanying drawings, in which FIGS. 1 to 4 are an isometric view, front elevation, side elevation and plan view, respectively, of a first form of shelf in accordance with the invention.

Figure 8:
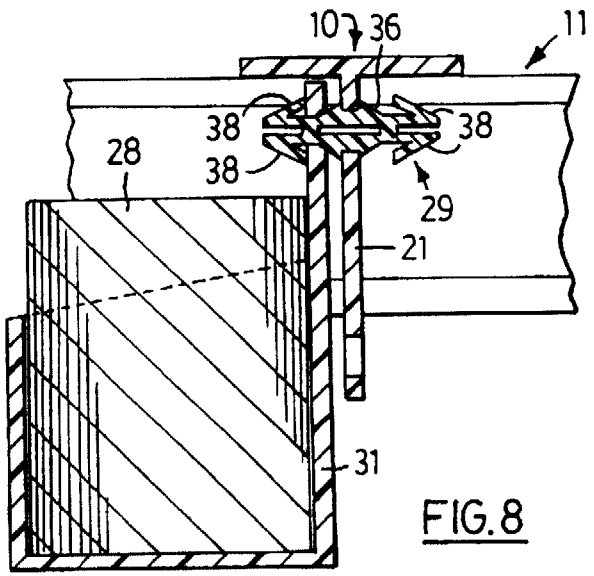
FIG. 8 is a side view partially in section along the lines 8—8 in FIG. 7.
Figure 8A:
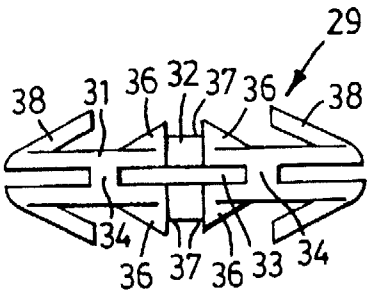

FIG. 8*a* is a side view of a fastening device used in attaching devices to the bracket.

Figure 5:
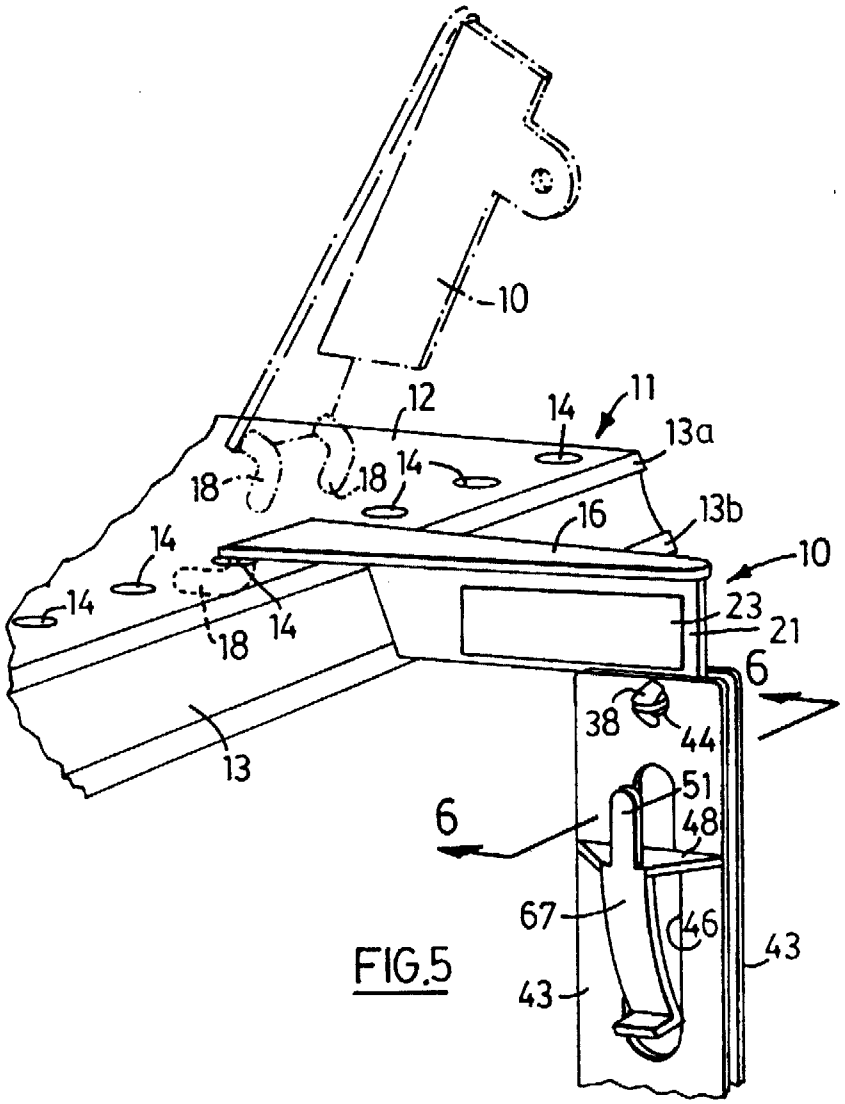
FIG. 5 is a perspective view showing application of the bracket of FIGS. 1 to 4 to perforated shelving.
Figure 9:
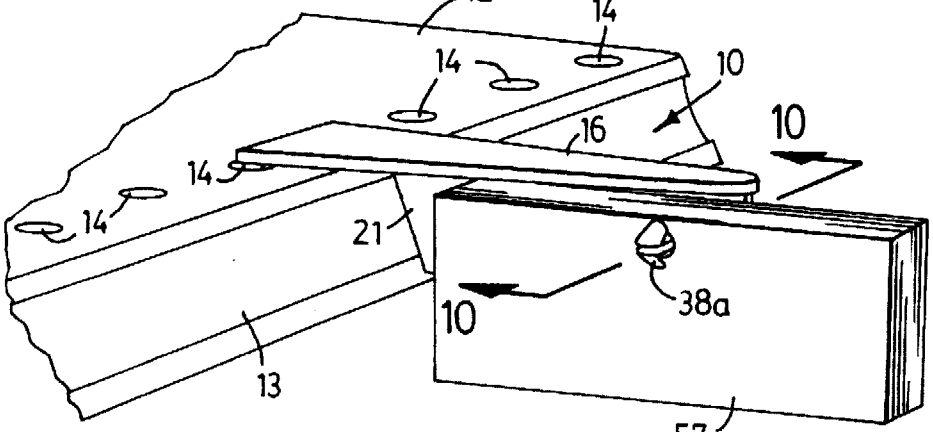
Figure 11:
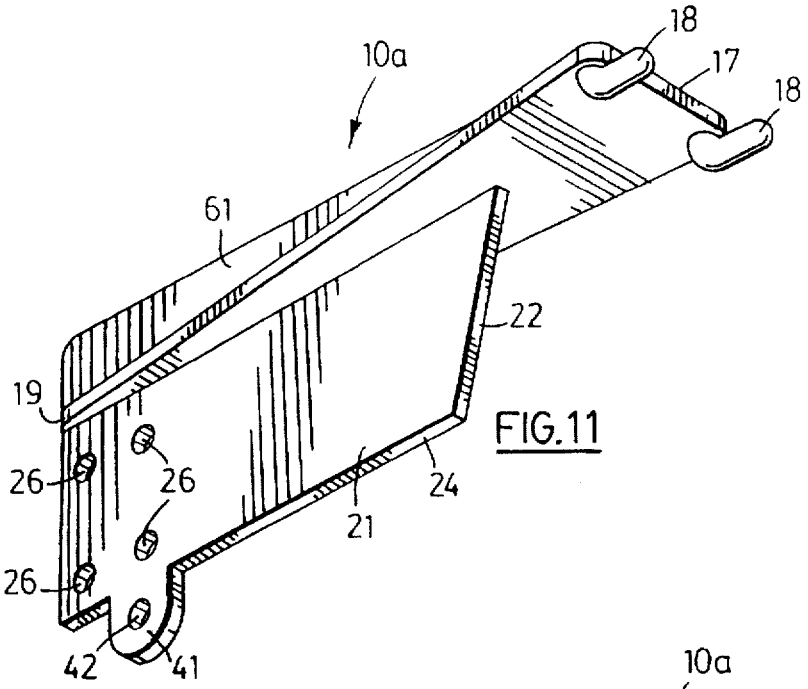
Figure 12:
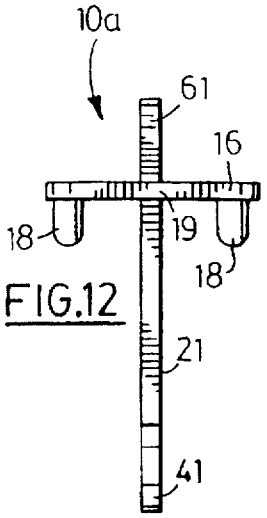
Figure 13:
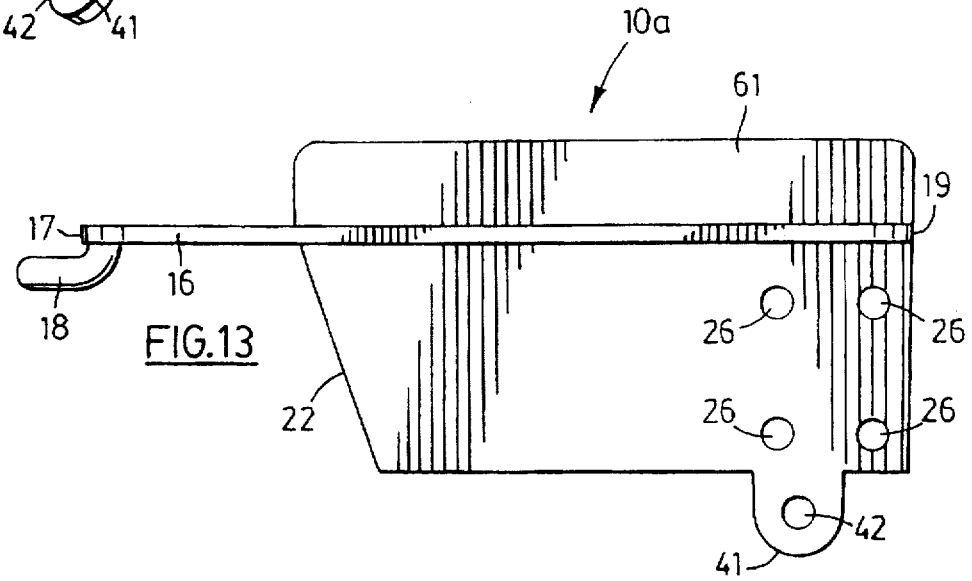
Figure 14:
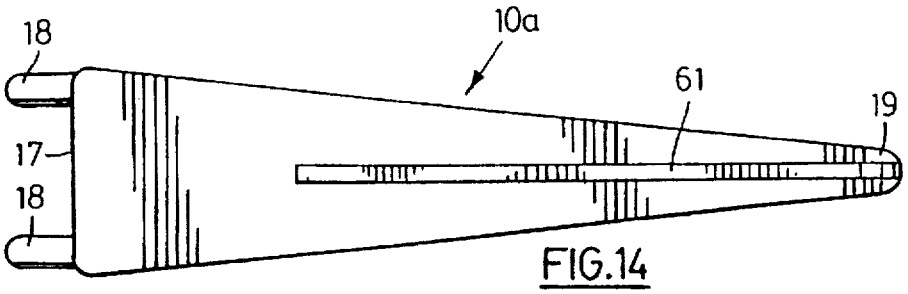

FIG. 9 is a view similar to FIG. 5 showing use of the shelving bracket in attachment of pads or printed material.

Figure 10:
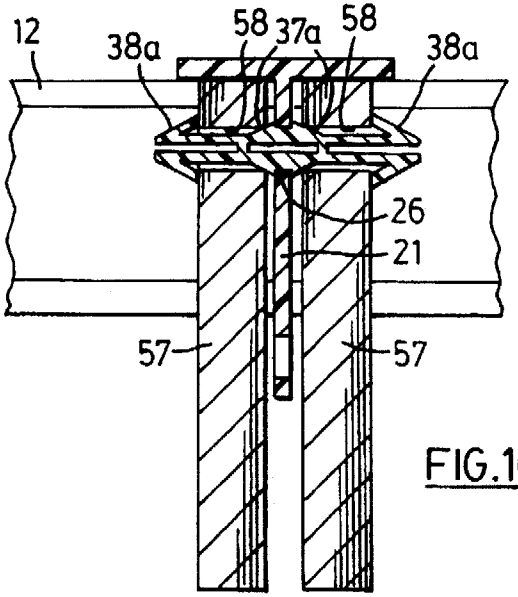

FIG. 10 is a side view, partially in section along the lines 10—10 in FIG. 9.

Figure 10A:
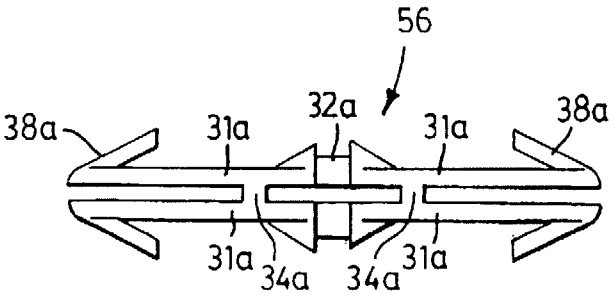

FIG. 10*a* is a side view of a modified form of fastening device.

FIGS. 11 to 14 are perspective front elevational side and plan views, respectively, of a modified form of bracket in accordance with the invention.

Figure 15:
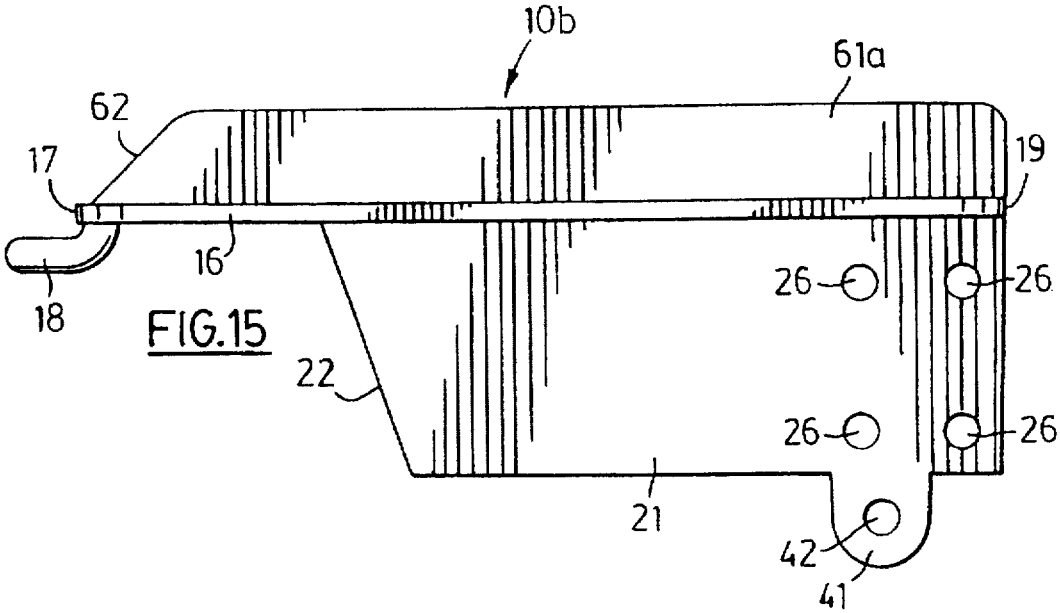
Figure 16:
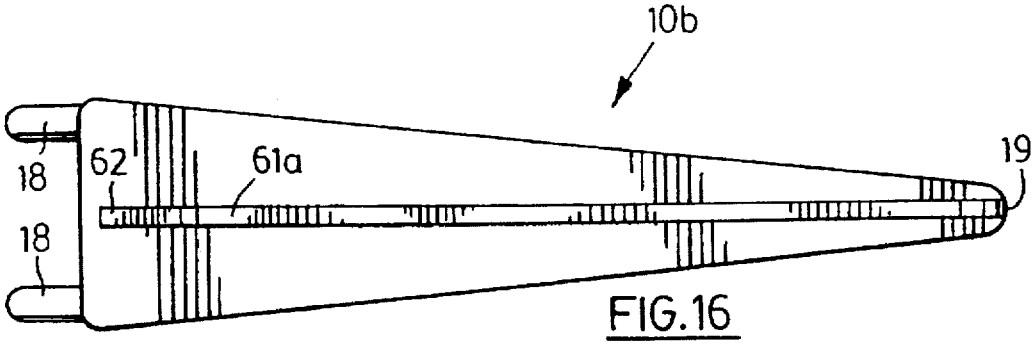

FIGS. 15 and 16 are side and plan views, respectively, of a further modified form of the shelf bracket.

Figure 3:
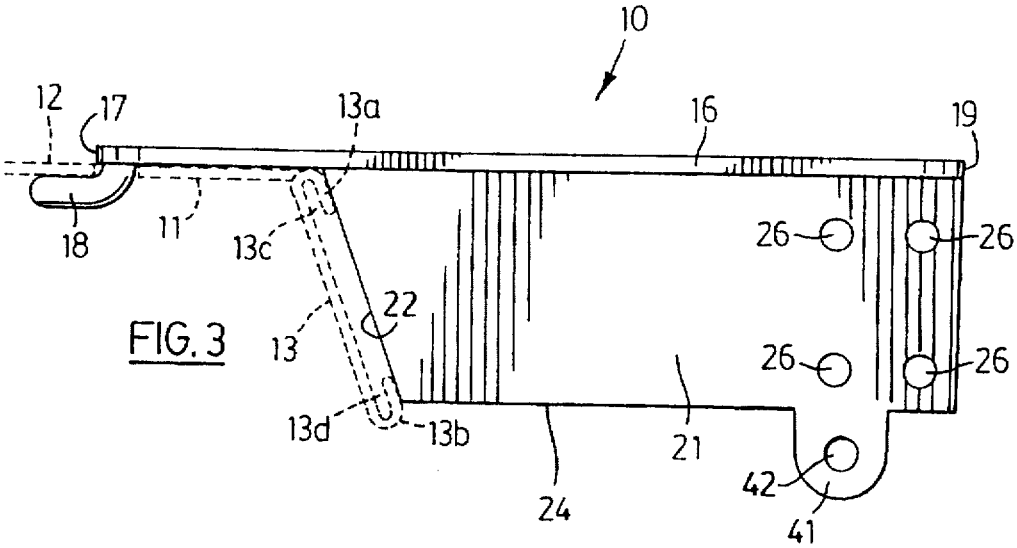
Figure 4:
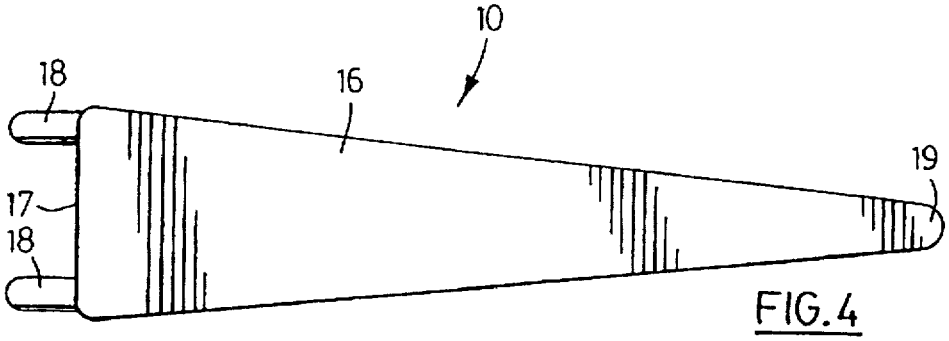
Figure 6:
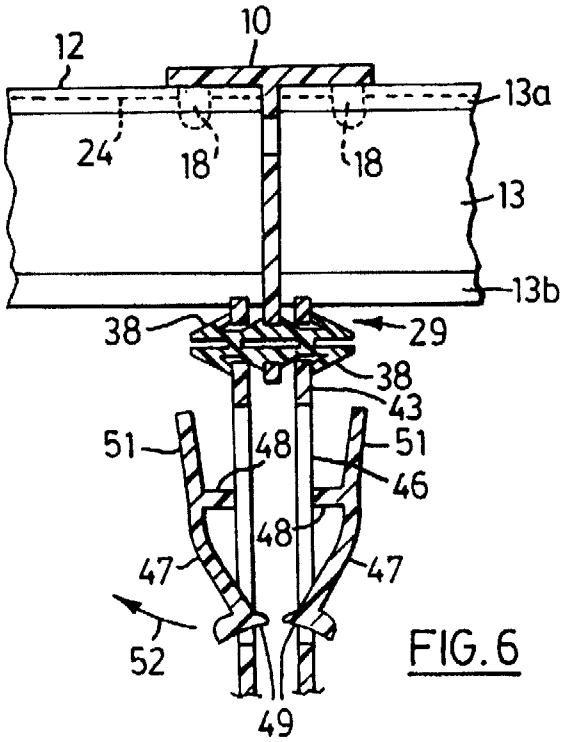
FIG. 6 is a front elevational view partly in section on the line 6—6 in FIG. 5.

Referring to the drawings, wherein like reference numerals indicate like parts, FIGS. 1 to 4 show a first embodiment of a shelf bracket 10 especially although not exclusively adapted for connection to shelving such as perforated sheet metal shelving as seen in FIGS. 5 and 6 and as shown in broken lines in FIG. 3. Such shelving 11 may comprise a sheet metal horizontal plate 12 and a forwardly and downwardly inclining front shelf edge flange 13, which may be in the form of a pricing channel having inwardly directed upper and lower lip portions 13*a* and 13*b* providing edge recesses 13*c* and 13*d* into which the edges of resilient cards, such as pricing cards or informational cards may be snapped to be retained and displayed on the front surface of the shelf edge 13.

The plate portion 12 is provided in conventional manner with a series of perforations 14 through it, the perforations 14 being spaced at regular intervals along the front edge a distance inwardly from the shelf edge 13.

The shelf bracket 10 comprises a unitary body molded as one piece from sturdy plastics material. For example, the bracket may be injection molded from conventional glass-filled nylon. The bracket comprises a planar plate portion 16 having a rear edge 17 adjacent which the body is formed with two laterally spaced and generally parallel downwardly and rearwardly extending L-shaped leg portions 18 which may be generally cylindrical as shown. The plate portion 16 tapers symmetrically of a longitudinal median line forwardly toward a rounded front apex 19 from the rear edge 17. Centrally of the plate portion 10, a bottom web 21 extends downwardly perpendicularly from the lower face of the plate 16. In the preferred form, the plate 21 extends to adjacent the apex 19 and has an upwardly extending rear facing edge 22 spaced forwardly from the leg portions 18.

In use, the web 21 may have applied to it information carrier materials, such as labels 23 as seen in FIG. 5, providing information such as consumer oriented information. Further as described below, merchandising devices may be fastened to the web.

In order to apply the bracket to the shelf, the legs 18 are passed through adjacent perforations 14, with the body of the bracket 10 inclined so that the rear edge 17 is inclined downwardly, as seen in broken lines in FIG. 5, and the body 10 is then pivoted downwardly to the position shown in solid lines in FIGS. 3, 5 and 6, wherein the underside of the rear portion of the plate 16 bears downwardly on the upper face of the shelf plate 12, and the upper edges of the leg portions react upwardly on and engage frictionally with the underside 24 of the shelf plate 12, so that the bracket 10 is retained firmly in place.

As best seen in FIG. 6, in use the web 21 extends transversely of the shelf 12 to display information carried on the sides of the web 21, and obscures only a very small portion of the shelf edge 13. For example, in a typical example, the web 21 may be only about ⅛" thick.

In the preferred form, the rear edge 22 inclines rearwardly upwardly from a bottom edge 24 of the web at an angle and position that matches the shelf edge 13 in the installed position, so that the rear edge 22 rests on the shelf edge 13 or on the lip flanges 13*a* and 13*b* as seen in FIG. 3, so that the shelf edge 13 offers further support to the bracket 10.

Figure 7:
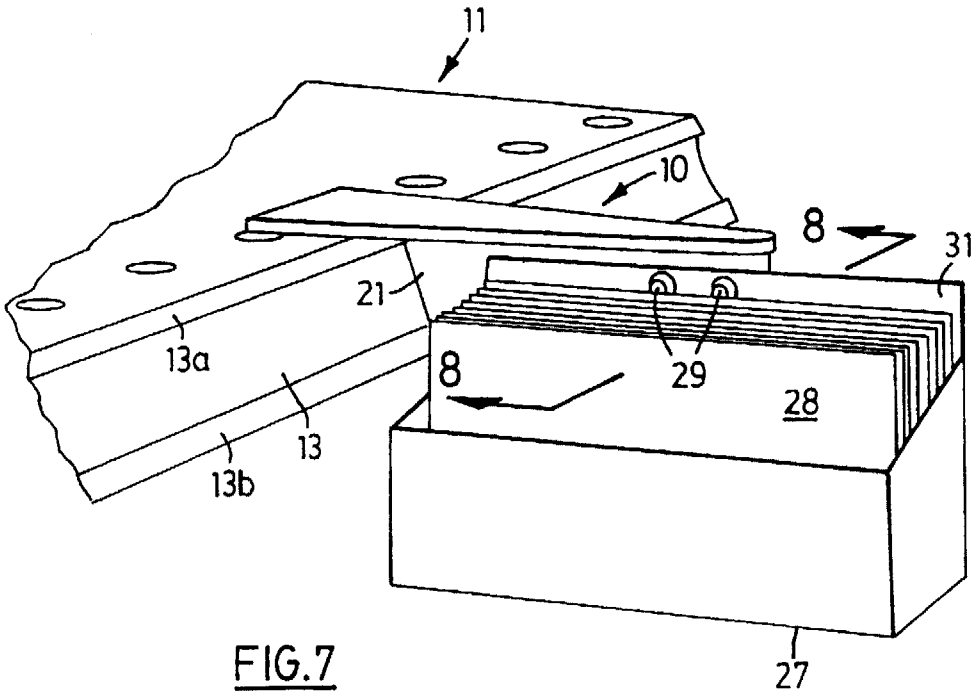
FIG. 7 is a view similar to FIG. 5 showing application of the bracket in attachment of a dispensing box for printed material.

In a preferred form, the web 21 has one or more holes 26 formed through it to facilitate connection of point of sale devices to the bracket 10. For example, as seen in FIGS. 7 and 8, a rigid open topped box-like holder 27 may be attached to the web 21 of the bracket. In the example illustrated, the box 27 contains informational material such as leaflet or coupon sheets 28. The holder 27 is attached to the web 21 with fastening devices 29 passed through a pair of openings in an upper end of a rear wall 31 of the holder 27 and through an upper pair of the openings 26 in the web 21. Conventional connectors may be used, for example snap fastening button connectors or a nut and bolt or the like, but in the preferred form a novel form of fastening device 29 as seen in more detail in FIG. 8*a* is employed. The fastening device 29 comprises a resilient plastic shaft 31, which has an enlarged width middle portion 32 preferably of circular or part circular cross section adapted to pass with a small clearance through the holes 26. In the example illustrated, the middle portion 32 comprises two substantially semi cylindrical portions separated by a rectangular slot 33. The slot 33 continues toward each end of the shaft 31 and is bridged by integrally molded bridge portions 34. An intermediate portion 36 on each side of the middle portion tapers in width inwards longitudinally outwardly from a stepped rear edge 37 providing a shoulder that is of somewhat greater diameter than the holes 26 in the web. When the fastening device 29 is introduced longitudinally inwardly through the opening 26, it snap fits into the installed position as seen in cross-section in FIG. 8 wherein the stepped rear edges 37 engage on opposing side surfaces of the web 21.

Outwardly from the intermediate portions 36, each end of the shaft 31 is provided with a longitudinally outwardly tapering arrow head formation 38 that is compressible resiliently transversely inwardly toward the shaft 31. In use, the arrow head formation 38 may be passed longitudinally inwardly through an opening or openings in the rear wall 31 of the device 27 of diameter similar to the diameter of the shaft 31, so that the arrow head formations 38 snap through the openings and retain the box-like device 27 connected to the web 21 in the installed position of the fastening device 29 as seen in cross-section in FIG. 8.

Figure 1:
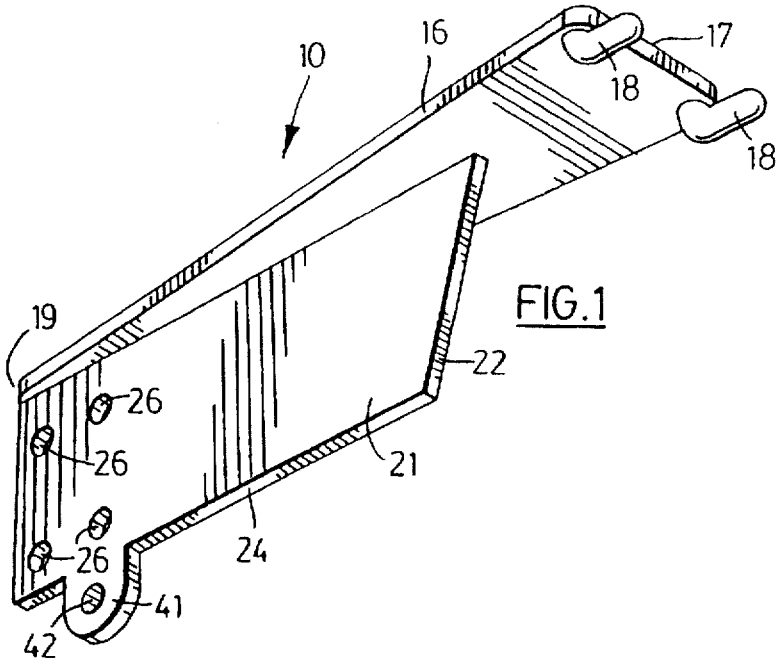
Figure 2:
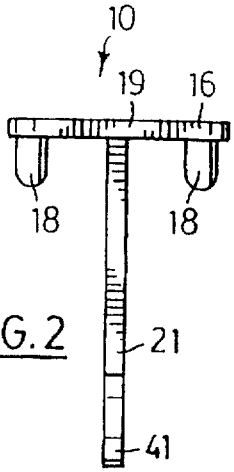

In a preferred form, the bottom web 21 has a lower tab portion 41 projecting downwardly from a lower edge 24 of the web 21 adjacent a forward end of the web 21. The lower edge of the tab portion 41 may be of generally semi-circular shape, as seen in FIGS. 1 and 3. The tab portion 41 has a hole through it, preferably substantially concentric with the part circular lower edge of the tab portion 41. The tab portion 41 may be used, for example, to attach merchandising strips 43 as seen in FIGS. 5 and 6. Each strip 43, which may be molded of resilient plastic material, has a hole 44 through an upper end of a diameter approximately matching that of the shaft 31 of the fastening device 29, so that a fastening device 29 having its middle portion 32 snap fitted through the hole 42 in the tab portion 41 may receive and retain a strip 43 on each of the arrow head formations 38. Each strip 43 may be a one piece structure integrally injection molded, for example, and has a series of elongated openings 46 along its length adjacent which is a gripper member 47 integrally molded on a cross piece 48. The cross piece 48 is itself integrally molded with the portions of the strip 43 on either side of the opening 46. In the as-molded condition, as seen in FIG. 6, a lower inwardly directed apex portion 49 of the gripper member 47 projects inwardly through the opening 46. Packages can be displayed on the merchandising strip 43 by depressing an upper finger grip portion 51 of the gripper member 47 inwardly, so that the apex portion 49 is rotated outwardly by pivoting resiliently about the cross piece 48, in the direction of the arrow 52 in FIG. 6. An edge of the package may then be inserted between the apex portion 49 and the opening 46 and the finger pressure released so that the package material is compressed and gripped between the apex portion 49 and the strip 43. Alternatively, packages provided with openings through them may be hooked onto the upper hook-like finger grip portions 51.

FIGS. 9 and 10 show the bracket 10 used together with a modified form of fastening device 56 shown in FIG. 10*a*. The modified device 56 has shaft portions 31*a* that are somewhat elongated as compared with the shaft portion 31 of the device of FIG. 8*a*, and are connected by a bridging portion 34*a* adjacent the middle portion 32*a* of the device. Otherwise, the fastening device is similar in structure and function to the device 29 described above in detail in connection with FIGS. 7, 8 and 8*a*. As seen in FIGS. 9 and 10, the fastening device may have its middle portion 32*a* snapped through an opening 26 of the web portion 21, to be retained therein by the stepped edge portions 37*a* engaging opposing faces of the web 21. The shaft portions 31*a* may be passed through somewhat thicker members, such as pads of tear-off coupons or informational leaflets 57, as seen in FIGS. 9 and 10, these pads 57 having opening 58 through which may be passed the arrow head formations 38*a* and shafts 31*a* to retain the pad members in the installed position as seen in FIGS. 9 and 10.

FIGS. 11 to 14 show a modified form of bracket 10*a*, similar in structure and function to the bracket 10 described above in detail with reference to FIGS. 1 to 10, except it has a top web 61, preferably of the same thickness as the bottom web 21, so that it likewise does not obscure any substantial area of shelf space, extending upwardly substantially perpendicular from the upper face of the plate portion 16 longitudinally rearwardly from the apex 19 toward the rear edge 17. The top web 61 may be used for display of labels and informational material applied thereon and positioned to extend transversely of the shelf edge 13, and so easily seen by a consumer proceeding in the longitudinal direction relative to the shelving of which shelf 12 forms part.

A further modified form of shelf bracket 10*b* is shown in FIGS. 15 and 16. This is again similar in its structure and mode of use to the brackets 10 and 10*a* described above, except it has a top web 61*a* that extends substantially the entire length of the upper plate portion 16, 19. This provides a somewhat larger area for application of informational material, and also serves to stiffen and strengthen the shelf bracket 10*b*, and provide increased resistance to bending and possible disengagement from the shelf 12 under heavy loading applied to the front end of the bracket 10*b*. Preferably, as seen in FIG. 15, the rear edge 62 of the top web 61*a* inclines upwardly forwardly away from the rear edge 17 of the plate 16, so that the rear edge 62 does not tend to interfere with the shelf 12 or items places on the shelf 12 when it is applied in the inclined position shown in broken lines in FIG. 5 during installation of the shelf bracket.

I claim:

1. A shelf bracket comprising a unitary one piece molded plastics material body comprising a planar plate portion, two laterally spaced and generally parallel downwardly and rearwardly extending L-shaped leg portions molded integrally with a lower face of said plate portion adjacent a rear edge thereof for engaging in and locating and retaining said first plate portion relative to respective perforations in a sheet form shelving member, said plate portion tapering in width toward a front apex from said rear edge, and a bottom web integrally molded with said plate portion and extending downwardly substantially perpendicularly from the lower face thereof longitudinally rearwardly from the apex toward an upwardly extending rear-facing edge spaced forwardly from said leg portions.

2. A shelf bracket as claimed in claim 1 wherein the bottom web extends substantially centrally of the planar plate portion.

3. A shelf bracket as claimed in claim 1 wherein the rear-facing edge of the web inclines rearwardly upwardly from a bottom edge thereof.

4. A shelf bracket as claimed in claim 1 wherein said body includes a top web integrally molded with said plate portion and extending upwardly substantially perpendicularly from an upper face thereof longitudinally rearwardly from the apex toward said rear edge of the planar plate portion.

5. A shelf bracket as claimed in claim 4 wherein the top web extends substantially centrally of the planar plate portion.

6. A shelf bracket as claimed in claim 4 wherein said top web has a rearwardly-facing edge inclining downwardly rearwardly from a top edge thereof to adjacent said rear edge of the planar plate portion.

7. A shelf bracket as claimed in claim 1 wherein said bottom web has at least one hole therethrough.

8. A shelf bracket as claimed in claim 7 wherein said at least one hole is adjacent said planar plate portion.

9. A shelf bracket as claimed in claim 7 wherein said at least one hole is adjacent a bottom edge of said bottom web.

10. In combination, a shelf bracket as claimed in claim 7 and a fastening device comprising a resilient plastic shaft having a middle portion sized to fit through said at least one hole, an intermediate portion on each side of the middle portion tapering in width longitudinally outwardly from a stepped rear edge and snap fitting said middle portion within said hole on longitudinal inward movement of one of said intermediate portions relative to said bottom web beyond said stepped edge, and an outer portion on each side of the intermediate portion having a longitudinally outwardly tapering laterally resiliently compressible arrow head formation adapted for snap fitting through an opening in a merchandising device.

11. The combination as claimed in claim 10 wherein said shaft has a central slot extending axially inwardly from each end thereof toward the middle portion.

12. A shelf bracket as claimed in claim 1 wherein said bottom web has a lower tab portion projecting downwardly from a lower edge of the bottom web adjacent a forward end of the bottom web, said tab portion having a hole therethrough.

13. A shelf bracket as claimed in claim 12 wherein said tab portion has a downwardly convex part circular lower edge and said hole in the tab portion is substantially concentric with said part circular lower edge.

* * * * *